US006720874B2

(12) United States Patent
Fufido et al.

(10) Patent No.: US 6,720,874 B2
(45) Date of Patent: Apr. 13, 2004

(54) PORTAL INTRUSION DETECTION APPARATUS AND METHOD

(75) Inventors: Michael Vincent Fufido, Melbourne Beach, FL (US); Giuseppe Pino Baldassarre, Indialantic, FL (US); Reginald Gary Moffat, Palm Harbor, FL (US)

(73) Assignee: IDS Systems, Inc., Melbourne Beach, FL (US)

( * ) Notice: Subject to any disclaimer, the term of this patent is extended or adjusted under 35 U.S.C. 154(b) by 116 days.

(21) Appl. No.: 09/968,361

(22) Filed: Sep. 28, 2001

(65) Prior Publication Data

US 2002/0067259 A1 Jun. 6, 2002

Related U.S. Application Data

(60) Provisional application No. 60/236,960, filed on Sep. 29, 2000.

(51) Int. Cl.[7] ..... G08B 13/00

(52) U.S. Cl. ..... 340/541; 340/5.2; 340/5.8; 340/528; 340/545.1; 340/556

(58) Field of Search ..... 340/541, 545.1, 340/5.2, 5.3, 5.31, 5.32, 5.33, 5.51, 5.52, 5.6, 5.8, 5.82, 555, 556, 557, 528, 309.16

(56) References Cited

U.S. PATENT DOCUMENTS

| | | | | |
|---|---|---|---|---|
| 3,701,100 A | * | 10/1972 | Yarbrough | 340/5.5 |
| 3,891,980 A | * | 6/1975 | Lewis et al. | 340/5.62 |
| 5,076,013 A | * | 12/1991 | Gallenschutz et al. | 49/42 |
| 5,305,390 A | * | 4/1994 | Frey et al. | 340/556 X |
| 5,317,309 A | | 5/1994 | Vercellotti et al. | |
| 5,325,084 A | * | 6/1994 | Timm et al. | 340/541 |
| 5,541,585 A | | 7/1996 | Duhame et al. | |
| 5,712,621 A | | 1/1998 | Andersen | |
| 5,845,692 A | | 12/1998 | Kellem et al. | |
| 5,992,094 A | | 11/1999 | Diaz | |
| 6,496,595 B1 | * | 12/2002 | Puchek et al. | 340/5.8 X |

* cited by examiner

*Primary Examiner*—Thomas Mullen
(74) *Attorney, Agent, or Firm*—John L. DeAngelis, Jr.; Beusse Brownlee Wolter Mora & Maire, P.A.

(57) ABSTRACT

A portal access control system is disclosed for preventing unauthorized entry from a public area into a secure area. The system utilizes input from several different sensors, including: passive IR sensors, motion detectors, photo detectors and authentication devices. Also, the passage time of an individual through the open portal may be determined. Based on selected combinations of one or more sensor inputs, the portal access control system can detect passage into the secure area by a lone perpetrator and also by tailgating behind an authorized user.

34 Claims, 7 Drawing Sheets

LEFT HAND DOOR

RIGHT HAND DOOR

LEFT HAND REAR DOOR

RIGHT HAND REAR DOOR

PORTAL INTRUSION DETECTION APPARATUS AND METHOD

This patent application claims the benefit of U.S. Provisional Application filed on Sep. 29, 2000, and assigned Application No. 60/236,960.

FIELD OF THE INVENTION

The present invention relates to a system and method for preventing unwanted intrusions into a secure or restricted area separated from a public area by an access controlled door. In particular, the present invention permits access to the secure area by authorized personnel after successfully executing an authentication process, while preventing access by unauthorized persons, especially those attempting to gain access to the secure area by piggybacking or tailgating behind an authorized entrant.

BACKGROUND OF THE INVENTION

Tracking of personnel entering or exiting high security areas continues to be a significant and vexing problem for the site operator. Unwanted intrusions into secure or restricted areas, such as certain airport zones, research and development laboratories, government facilities, industrial sites and areas designated as secure for proprietary or national security reasons must be prevented, while minimizing the inconvenience experienced by authorized users. Typically, a significant number of users must gain access to the restricted area, providing ample opportunities for the unauthorized entrants to also gain access to the work area. The placement of guards and various screening devices at the entrance to the restricted area are known. Access cards and electronically-controlled portal admission devices are also known and used to initially distinguish, i.e., authenticate, authorized from unauthorized personnel.

An airport is typical of the complex needs of a modern secure site. Portals into the high security runway and baggage areas, for example, can be monitored by guards stationed at the portal or at a security center with visual communication to the secure portal. Also, the portal can be provided with optical or electronic card readers. Generally, such single line defense systems are inadequate for these tight security zones. For example, one particular intrusion scheme not easily detected by prior art detection systems (except for a human guard) is the so-called "piggybacking" or "tailgating" scenario where an unauthorized person follows close behind an authorized individual through the secure portal. Frequently, the authorized user simply assumes that the tailgater is also authorized to enter the secure area. To further conceal his unauthorized status, the tailgater may wear a stolen, counterfeit or expired badge that appears legitimate to the casual observer, especially to the authorized user who unwittingly allows the unauthorized person access to the secure area.

The consequences of an unauthorized intrusion can be serious. Valuable personal and intellectual property can be stolen, and there is an ever-present potential threat to personnel in the secure area. Intruders on an airport site represent a breach of Federal Aviation Administration Regulations, which are enforceable by both civil an criminal actions.

The access control system of choice will be minimally intrusive and exceptionally accurate so that all authorized users are permitted entrance while all unauthorized users are deterred. Visual identification by a portal guard, although requiring constant attention and surveillance of the portal area, is perhaps the best protection mechanism. However, it also tends to be the most expensive. In large industrial and commercial sites, such as an airport, it is financially and pragmatically prohibitive to position a guard at each of the numerous portals into the numerous secure areas. Certain positive access control doors, such as turnstiles and revolving doors are usable in certain applications for thwarting piggybackers. However, revolving doors do not allow the entrant to carry or transport relatively large items into the secure area and may also be violative of certain fire and exit codes. More complicated "mantraps" define a compartment bounded by two doors. Access to the restricted area is gained by first entering the outer door from the public side, closing the public side door, identifying or authenticating the individual as an authorized user and finally opening the door into the secure side. Disadvantageously, such mantraps are expensive, physically large and significantly intrusive. The security device employed at a portal must generally also allow for rapid egress from a secure area in the event of an emergency or life threatening situation. Certain underwriters' laboratory (UL) and fire and building codes must be complied with in the design of portal security devices. The intrusion detection device may also be required to comply with the Americans' with Disabilities Act and the regulations promulgated thereunder.

BRIEF SUMMARY OF THE INVENTION

The various disadvantages discussed above in conjunction with prior art portal access management systems or intrusion detection systems are overcome by the portal access control system constructed according to the teachings of the present invention, allowing controlled access to a secure area only by authorized users and thus precluding the entry by both the innocent wanderer and the determined perpetrator. The portal access control system ensures that when an individual is authorized entry to the secure area, that access is granted to only a single user. Each entering user must be granted individual access authorization or certain protection and alarm systems are activated. Interlopers or piggybackers following behind the authorized user are detected and local alarms activated and output signals generated to alert remote security personnel. In addition, for example, closed circuit television cameras can also be activated to record activity in the portal area.

Generally, the portal access control system according to the present invention will always be activated to monitor and control authorized entry to a secure area from a public area. The system can also be configured to monitor and/or control exit from the secure area to the public area.

In one embodiment, the portal access control system is adaptable and integratable with existing door hardware. A first system component, comprising a plurality of sensors, is mounted to or adjacent the door frame. The second component comprising controller and logic elements can be located anywhere within the facility. The two components communicate via either a wired or wireless link, as chosen by the site operator. The first component, in particular the doorway sensors mounted therein, are applied to the push side of the secure door such that the door does not open into the frame mounted sensors. The door frame component can be customized as required for dimensional and structural compatibility with existing door and frame hardware. The control logic component can also be customized for integration with existing access control and monitoring systems. In all cases, all life safety and UL requirements are maintained after installation of the portal access control system of the present invention.

The primary protection aspects of the system are activated when an authorized user is authenticated for entry into the secure area. The authentication process can be executed with a key operated switch, a personal identification number code entered into a key pad, a biometrics reader or a card swipe process. In another embodiment, system activation occurs when a user enters a defined zone proximate the controlled portal. Sensors included within the portal access control system, monitor individuals passing through the doorway and also those in the general area of the secure portal. A series of logical operations are performed, based on the various sensor inputs, to detect passage of the authorized user through the secure portal (including any objects the individual may be carrying or transporting through the portal) and the attempted passage of an unauthorized intruder.

In one embodiment, the input sensors comprising the system include a plurality of photo detectors mounted on the door frame at various heights above ground. Typically, the photo detectors are mounted in pairs so that the individual's direction of travel through the portal can be determined. Presence or motion detectors, that is radar type (e.g. microwave) detectors and passive infrared detectors determine the presence of individuals and objects within the zone immediately surrounding the secure portal. Video cameras including infrared presence detectors can also can also provide input or detection information. The user authentication device, keypad, card reader, etc. provides yet another input to the system. The controller operates on the sensor input signals applied thereto for detecting an authorized and an unauthorized passage through the portal. The system can also be controlled remotely to enable free exit or entry activity, the latter in the case of the occurrence of an emergency condition on the public side of the portal. The portal access control system can also provide various output signal information to related security systems, including, for example: door position status to confirm whether the door is in an open or closed position; a valid pass from the public side to the secure side; a valid pass from the secure side to the public side (this pass can be either controlled or uncontrolled); a door open time, indicating the period in which the door remained opened; and obviously secure entry violations confirming that a transgression of the secure system has occurred. In those installations where free exit from the secure area is permitted, the exit direction violation output signal is not available.

When an unauthorized entry into the secure area is detected, a plurality of different alarms and indicators can be activated including, a local horn, a strobe light, an emergency flasher, and a various status indicators at a security monitoring station. A voice alert can also be given to the unauthorized user demanding that the user leave the secure area and return to the public side of the portal. Another voice audio alert advises users to close the door because it is being held open beyond the programmed period assigned to a valid entry or exit. To further allow implementation with existing door security hardware, the portal access control system can be integrated with automatic door openers and retractor panic devices. The system is also integratable with fire control and safety systems and can further be placed in a bypass mode (in either or both directions) by security personnel during an emergency situation.

BRIEF DESCRIPTION OF THE DRAWINGS

The foregoing and other features and advantages of the invention will be apparent from the following detailed description of the preferred embodiments as illustrated in the accompanying drawings, in which like referenced characters refer to the same parts throughout the different figures. The drawings are not necessarily to scale, emphasizing instead the principles of the present invention.

DETAILED DESCRIPTION OF THE INVENTION

Figure 1:
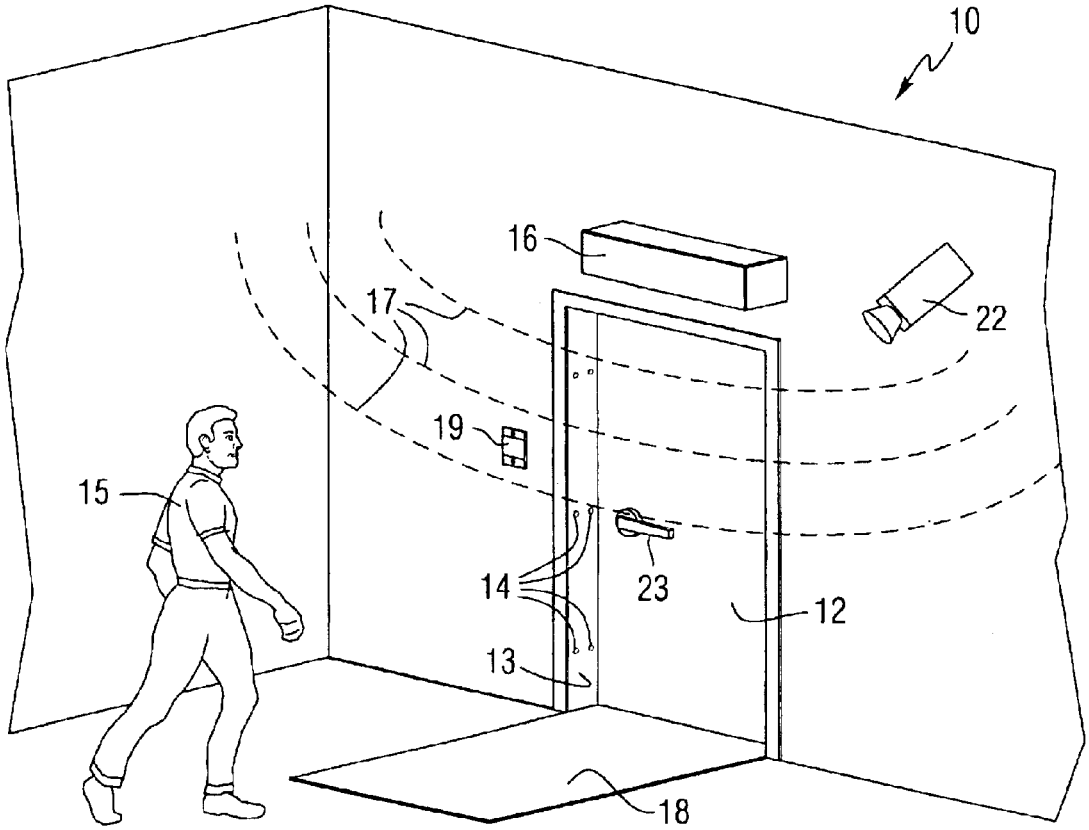
FIG. 1 is a diagrammatic representation of a security system according to the teachings of the present invention.

Before describing in detail the particular apparatus and method for controlling secure portal access in accordance with the present invention, it should be observed that the present invention resides primarily in a novel combination of processing steps and hardware elements related thereto. Accordingly, these processing steps and hardware elements have been represented by conventional processes and elements in the drawings, showing only those specific details that are pertinent to the present invention so as not to obscure the disclosure with details that will be readily apparent to those skilled in the art having the benefit of the description herein.

Generally, the portal access control system of the present invention employs a plurality of sensors or detectors employing differing detection principals to detect the presence of a person in the vicinity of the secure portal and further to determine if the person has moved through the portal alone, that is, detection of a second person passing through the portal coincident with the passage of the authorized person. Both active sensors (which inject some form of energy, e.g., light, microwave or sound) and passive sensors (which detect energy already in the environment) can be employed in the portal access control system. Once an individual who is expected to seek access through the portal has been detected, the portal access control system is activated to ensure that only one authorized individual passes into the secure area by way of the secure portal. An authentication device (a card reader) is activated by the user, for instance by swiping a personally-assigned badge or card through the card reader. The security door is unlocked and the user passes through it. Sensors mounted on or proximate the door frame (where the location is determined by the physical configuration of the door and surrounding area) detect the individual's passage through the portal. Using pairs of closely spaced sensors, the individual's direction of travel can also be detected. In another embodiment, a video camera can be employed in lieu of or in addition to the door frame sensors. Certain other sensors can detect whether the individual is carrying an object, a briefcase or a suitcase, for example, and using this information the time expected for the individual to pass through the door is calculated. If the door is held open for a time greater than this value, then it is possible that an unauthorized user has also passed through the portal. Further, if photodetectors placed at approximately waist height detect an individual passing through the door and then immediately thereafter detect another object or person passing through the door, then likely an intruder has attempted passage into the secure area. Various combinations of these sensors are utilized to accurately detect the presence of a second individual in the area proximate the portal and the further passage of this individual through the secure portal. The information from the plurality of different sensors is analyzed by a programmable logic controller to determine the unauthorized passing of an individual through the secure portal.

FIG. 1 illustrates one embodiment of a portal access control system 10 constructed according to the teachings of the present invention. A security door 12, including a door frame 13 and a plurality of sensors 14, separates a public area from a secure area. An individual 15 in the public area desires to pass through the security door 12 into the secure area. A detector 16 emits radio waves (for instance at a microwave frequency) shown generally in FIG. 1 and identified by reference character 17, to detect the presence of an individual or object within the area proximate the security door 12. In another embodiment, the detector 16 comprises a passive infrared detector for detecting the heat radiated by all bodies and objects and thus determining the presence of an individual or object within the proximate zone. A floormat 18 can be used alone or in conjunction with other presence detectors to detect the presence of an individual adjacent the security door 12.

An authentication device 19 for authenticating the individual to access the secure area is positioned near the security door 12. To authenticate the user, the authentication device 19 can employ any one or more of the following techniques. If the authentication device is a simple card reader, the user can swipe a personalized badge or a card through a slot in the authentication device 19. If the swiped badge or card represents that of a permitted entrant into the secure area, the security door 12 is unlocked and the user 15 can open the door by turning the door handle 23. A keypad for entering a personal identification number can also be used as an authenticating device. Also, biometrics information (e.g. retinal eye patterns or voice patterns) can be provided to the user by way of the authentication device 19. The provided biometrics information is compared with stored information taken from permitted entrants, and if a match is determined, then the individual is a permitted entrant into the secure area and the security door 12 is unlocked. In another embodiment, the security door 12 can provide access to a secure area from outside a building or structure, rather than an interior public area as illustrated in FIG. 1. A camera 22 is also illustrated as another source of information for use by the system of the present invention and especially for real-time analysis by security personnel. The viewing area and panning rate of the camera 22 are programmable. As is the case with the various other sensors illustrated in FIG. 1, the output signal from the camera 22 is input to a programmable logic controller, discussed further below but not shown in FIG. 1, where analysis of the various sensor inputs occurs and further from which signals are supplied to other fire/emergency/security personnel. For example, the camera output signal is supplied to a security control center.

In one operational mode, when the security door 12 is unlocked from the secure area, either manually (in an application where free access is permitted out of the secure area) or by use of an authentication device similar in structure and function to the authentication device 19, a person can pass to the public side. During this time period and until the security door 12 is again locked, the plurality of sensors 14 detect the passage of a person, who has not been authenticated by the authentication device 19, from the public side to the secure side. The latter person will be traveling in the opposite direction than the former and thus can be detected by a pair of side-by-side mounted sensors 14, based on which of the two beams was broken first.

As will be discussed below, in one embodiment a timer is activated when an individual is authenticated to pass through the security door 12, for measuring the time during which the door is open. If this time exceeds a predetermined limit then it is possible that a second person has passed through the door immediately following the passage of an authorized individual.

Figure 2:
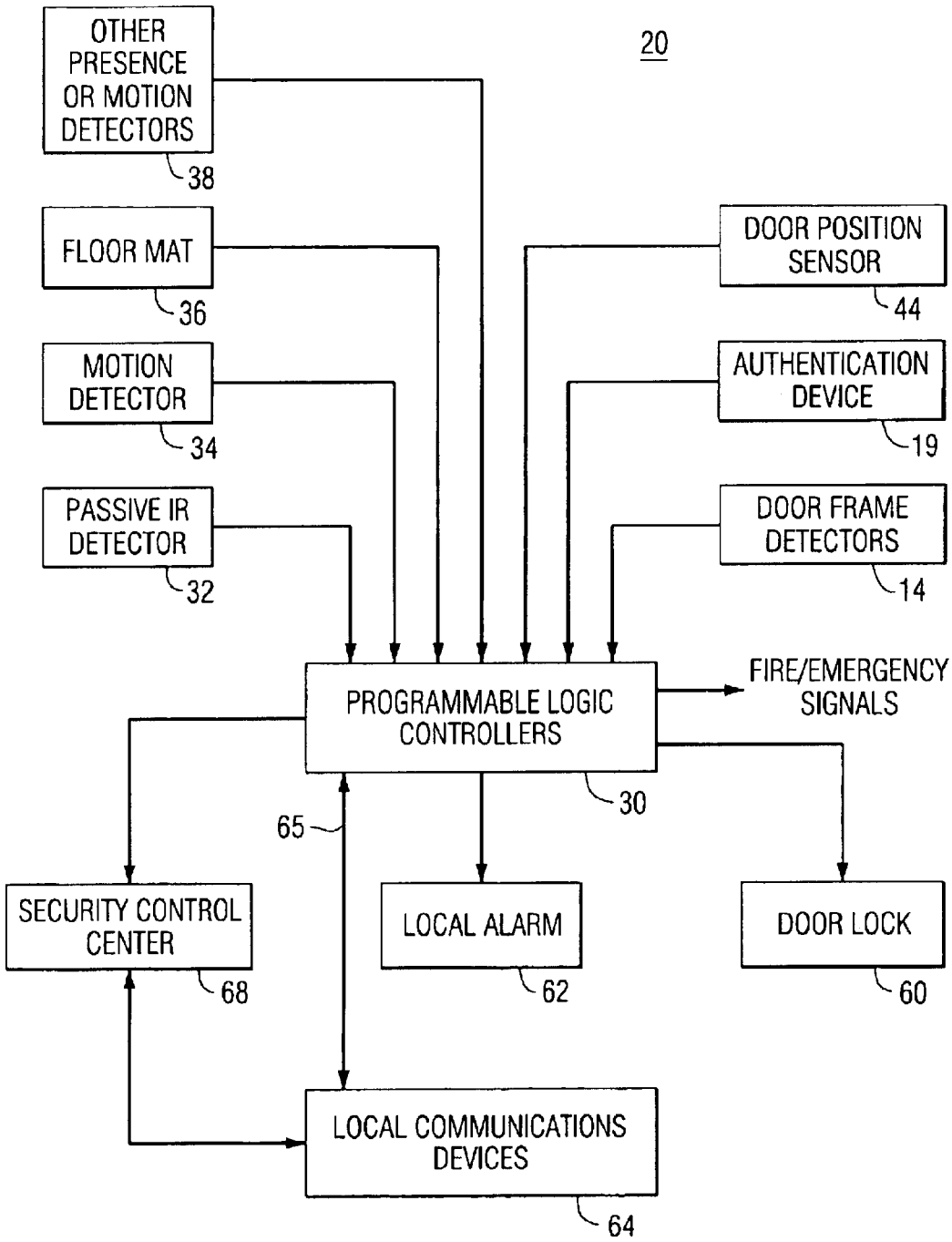
FIG. 2 is a block diagram of the portal access control system according to the teachings of the present invention.

FIG. 2 is a block diagram of the principal component according to one embodiment of the portal access control system 20. Several input signals are provided to a programmable logic controller 30 for controlling access to the secure area behind the security door 12 and for further determining whether an unauthorized individual has entered the secure area by piggybacking or tailgating behind an authorized and authenticated user. Operating on the inputs provided, the programmable logic controller 30 provides various output signals, including a signal to unlock the security door 12, and other alarm signals in the event an unauthorized entrant enters the secure area.

One device for determining the presence of a person or object within a zone surrounding the security door 12 is a passive infrared detector 32, which is shown as providing an input to the programmable logic controller 30 of FIG. 2. It is known that infrared energy is emitted by all objects and living bodies at a frequency determined by the object's temperature. Humans, having a skin temperature of approximately 93° F. radiate infrared energy with a wavelength of between 9 and 10 micrometers. The passive infrared detector 32 is therefore designed to respond to energy within that wavelength band. When a person walks into the field of view of the passive infrared detector 32, a sharp increase in infrared energy is detected. Because there will always be gradual heat energy fluctuations in any area, the passive infrared detector 32 is designed to sense only infrared energy levels that change very rapidly, which would signal the presence of a person or object in the approach zone to the security door 12.

The passive infrared (IR) detector 32 includes an adjustable sensitivity and distance setting. The sensitivity may be adjusted such that only persons and large objects are detected. The passive IR detector 32 can further be adjusted to detect persons and objects within a particular distance and at a specified angular relationship to the security door 12. In this way, an approach zone can be defined and monitored by a single passive IR detector, or in an other embodiment a plurality of such detectors can be located so that each detector monitors a different region of the zone. In this way, the portal access control system 20 monitors the movement of individuals within and between various regions of the approach zone. When properly adjusted, the passive IR detector sensitivity is established so that individuals outside the approach zone, for instance walking in the public area near the approach zone, but not approaching the security door 12 are not detected.

In one embodiment, once a person is detected in the proximate zone, the monitoring process can begin, for example, a camera can be activated to record the individual's whereabouts in the proximate zone. The presence detector can also be used to indicate that an intruder has left the secure zone.

As determined by the particular installation and security requirements, a passive IR detector 32 can be mounted on both the public and secure sides of the security door 12. When mounted on the secure side, the passive IR detector signal indicating the presence of an individual in the secure-side approach zone can cause the door to automatically unlock, permitting easy access from the secure to the public side.

Another source of presence information is provided by a motion detector 34. Like the passive IR detector 32, the motion detector 34 detects the presence of an individual or object within an approach zone surrounding the security door 12. There are several motion detector embodiments usable in the portal access control system 20. For instance, in one embodiment, the motion detector 34 transmits bursts of microwave radio energy and analyzes the reflected return energy by comparing it to the expected reflections from the monitored area, in the absence of any person or object within that area. A disturbed reflection pattern indicates that a person or object has entered the monitored area. In response, a signal is sent from the motion detector 34 to a programmable logic controller 30. The use of the presence information by the programmable logic controller 30 will be discussed below. In lieu of using microwave energy to detect presence, the motion detector 34 can transmit ultrasonic sound waves and analyze the return energy in much the same way as the reflected microwave energy is analyzed. A focused beam of laser light can also be emitted and the reflections sensed by a light sensor. The motion detector 34 can be mounted on either or both sides of the security door 12, depending upon the specific requirements of the installation and the need to monitor presence on the secure side of the security door 12.

The floor mat 18 shown in FIG. 1, also known as a floor contact pad, also provides a presence signal to the programmable logic controller 30. In one embodiment, the floormat 18 comprises two plates representing two terminals of a switch separated by a non-conductive dielectric. When an individual or object is placed on the floormat 36, the object's weight applies a downwardly directed force that closes the contacts; the closure signal is supplied to the programmable logic controller 30 to indicate the presence of a person or object at the security door 12. Depending on the requirements of the installation, floormats 18 can be placed on either one or both of the public and the secure sides of the security door 12.

Other presence, motion or proximity detectors can be utilized in conjunction with the present invention. These are indicated generally by a reference character 38 in the FIG. 2 block diagram. Generally, these other detectors are mounted near the security door 12 to sense the presence of an object or person in the approach zone from either the secure side or the public side. All operate by detecting a change in an energy pattern of the monitored zone. For instance, in an embodiment of the present invention where the security door 12 is positioned at the end of a corridor, photodetectors placed along the corridor walls respond to an energy beam emitted from photoemitters located on correspondingly opposing sides of the corridor wall. The individual breaks the energy beam as he passes down the corridor, thus producing a signal representative of the individual's presence in the approach zone to the security door 12. Thus different embodiments and installations of the present invention necessitate the use of one or more presence detectors.

A door position sensor 44 provides a signal to the programmable logic controller 30 that indicates whether the door is opened or closed. There are a number acceptable sensors for accomplishing this objective. For example, a simple mechanical plunger type switch can be mounted on the door or the door frame. The switch is spring bias in a normally open position and the force of the closed door against the plunger closes the switch contacts. A photo emitter/photo detector pair mounted in opposingly directed orientation, one on the door frame and the other on the door, can also supply a signal representative of the door position. In another embodiment, the door position signal can be supplied by a switch mechanism coupled with the engagement of the door lock with the striker plate on the door frame. Finally, the separation between the two plates of the door mounted hinges can serve as a door position indicator. Those skilled in the art are aware of many available devices for providing door position status.

The authentication device 19 shown in the FIG. 2 block diagram and in the FIG. 1 pictorial diagram, can be implemented with several different types of authenticating features, as discussed above in conjunction with FIG. 1. Any of the following authentication devices can be used alone or in combination to authenticate a user for access to the secure area: a card or badge reader, a key switch, a biometrics reader, an intelligent key (for example, one programmed to allow admittance during certain times of the day and to deny admittance during other times) or a numeric/alphabetic key pad. In any case, the information entered in to the authentication device 19 is compared with information stored in a database of authorized users. If a match is detected, the user is granted access. The comparison and decision-making software elements can reside in the programmable logic controller 30, which receives the information from the authentication device 19 or the authentication device 19 can be operable in a stand-alone mode to execute the comparison and decision-making process. Thus it is not necessarily required that the reader and its associated elements be located physically adjacent each other.

If the user is declared a valid entrant to the secure area by the authentication device 19, an authentication signal is supplied to the programmable logic controller 30. As will be discussed further below, the programmable logic controller 30 in response unlocks the security door 12 and in a preferred embodiment activates a timer.

The physical location of the door frame detectors 14 for monitoring passage through the security door 12 is shown in FIG. 1. In one embodiment the door frame detectors 14 are mounted in two u-shaped extrusions, which are then affixed to the two vertical members of the door frame 13. The extrusions are customized to fit the door frame dimensions and thus any existing door frame size can be accommodated and retrofitted for installation of the portal access control system 20. The entire portal control access system 10 is modular and thus can easily accommodate any site-specific installation environments. Further, the portal control access system 10 can be interfaced with any existing door security hardware, wherein the latter performs only the authentication process and supplies the portal control access system 10 with a signal indicating whether the authenticating individual is authorized to enter the secure area. The extrusions can be mounted to the inwardly-facing door frame surface or the outwardly-facing surface (on the side of the security door 12 opposite to the direction of door movement). In one embodiment the door frame detectors comprise a photo emitter emitting a focused propagating electromagnetic signal to the opposing door frame, where a photo sensor is responsive to the propagated signal. When there is a clear path between the photo emitter and the photo sensor, the light beam passes there between and is detected by the photo detector. When a person or object traverses through the beam, the path is broken and this is sensed by the photo detector. Alternatively, in another embodiment both the photo emitter and detector are mounted on one of the vertical door frame members (typically in a single package) and the opposing door frame serves as a reflector for the emitted beam. Again, when the signal path is disrupted by the presence of a person or an object the resulting broken beam is detected by the photo detector. Other types of proximity detectors can be used in lieu of the photo emitter/photo sensors such as a digital or audio camera, which may further include one or more presence or motion sensors of the type described above. As shown in FIG. 1 in one embodiment two such photo emitting devices are placed in a side-by-side orientation on the door frame 13. Use of two electromagnetic beams allows detection of the entrant's travel direction, as determined by which of the two beams is interrupted first.

The door frame detectors 14, in conjunction with the programmable logic controller 30 are capable of identifying and distinguishing a hand-carried suitcase, for example, by examining the pattern of broken light beams. The suitcase interrupts the beams from approximately 18" to approximately 36" above the floor, but a tailgating person interrupts all light beams from the floor to the top of the individual's head. In this way the programmable logic 30 can distinguish a suitcase from an unauthorized tailgater. A shopping cart can be detected by the pattern of interrupted beams in conjunction with the lack of heat detected by the passive IR detector 32. A shopping cart generally protrudes ahead of the individual and therefore the pattern of broken beams can be correlated with the identification of a person (from the passive infrared detector 32) to identify a non-human object passing through the door fame detectors 14 in advance of the person. In another embodiment, a video image of the proximate zone can be analyzed in real-time by security personnel, and in this way it can be determined whether the entrant is carrying or transporting an object. Once this information is known, the security personnel can properly set the door timers, as discussed herein, so that the entrant will have sufficient time to pass through the door before an alarm is activated.

The programmable logic controller 30 produces a plurality of output signals as indicated in the bottom region of FIG. 2, including a lock door and an unlock door signal. A door lock 60 is controlled by the lock door signal in response to the various input signals programmable logic controller 30 and the relationship between those input signals. The programmable logic controller 30 utilizes hardware elements, software elements or a combination of hardware and software elements to implement the logical relationships between the input signals to produce the necessary output signals. The details of this process are illustrated in the flow chart of FIG. 3 to be discussed below.

In one embodiment the door lock 60 comprises an electromagnet mounted on the door frame for contacting a magnetic strike plate on a corresponding top area of the door. When the electromagnet is energized by a lock signal from the programmable logic controller 30, the strike plate is held against the electromagnet and the door is held in a closed or locked position. Under control of the programmable logic controller 30, the authentication device 19 or personnel in the security control center 68, the electromagnet is deenergized to release the striker plate and thus allowing the security door 12 to be opened.

The programmable logic controller 30 can also activate a local alarm 62 and control and activate a local communications device 64 via control signals on a control line 65. Included among the latter are a closed circuit TV for display on both the public and secure side of the security door 12 and in a separate site security control center 68, a video tape recorder for recording the television signal, and a public address system and intercom providing bi-directional communication with the security control center 68. The intercom generally comprises a speaker and a microphone mounted on or near the door frame 13, with a corresponding microphone and speaker mounted in the security control center 68. Thus, an individual who has been denied access to the secure area can communicate directly with security personnel in an effort to resolve the issue. The public address system includes at least one speaker mounted on the public and/or the secure side of the security door 12 for commanding the user as appropriate. For example, the user can be directed to step away from the door if he has attempted a piggyback with an authorized user. According to the requirements of the site, a single or a plurality of video cameras can be mounted in the area adjacent the security door 12 to monitor activities occurring in the proximate zone. Control of the local communications devices 64 is provided, at least in some measure, by the programmable logic controller 30 as determined by the various input signals thereto and further by personnel in the security control center 68. Thus, for instance, a video camera in the vicinity of the security door 12 can be activated by a signal from the programmable logic controller 30, while the panning that camera to observe various scenes in the area is under control of an operator in the security control center 68. In another embodiment, the camera can also be activated directly from the security control center 68 as well as by the programmable logic controller 30. The programmable logic controller 30 also produces fire/emergency signals. For example, if the passive infrared detector determines a relatively high-temperature object in the proximate zone, this may be an indication of a fire in that area and in response the programmable logic controller produces an emergency/fire signal to the security control center 68 or to an off-site location, as desired by the customer.

Figure 3:
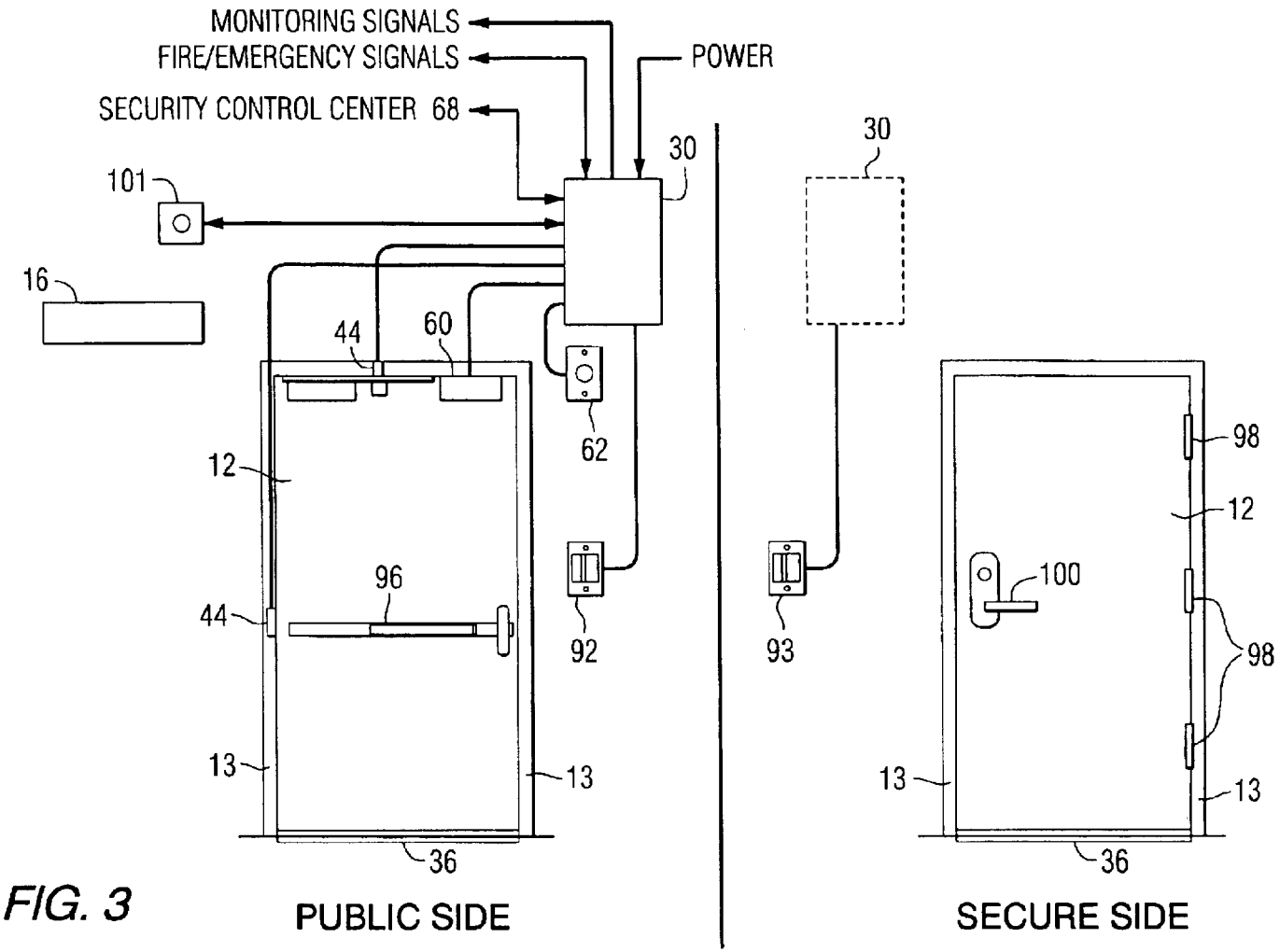
FIG. 3 is a diagrammatic representation of a security door protected by the portal access control system.
Figure 4A:
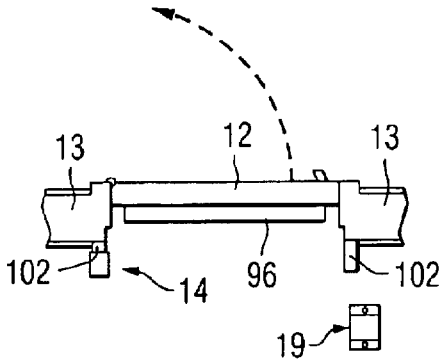
FIGS. 4A, 4B, 4C and 4D illustrate implementation of the present invention for several different door types.
Figure 4B:
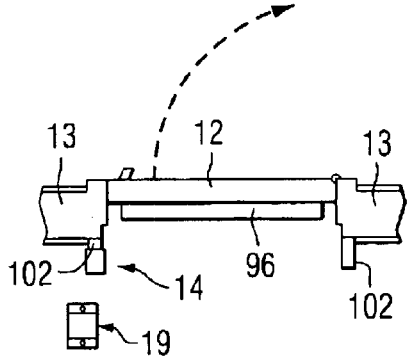
Figure 4C:
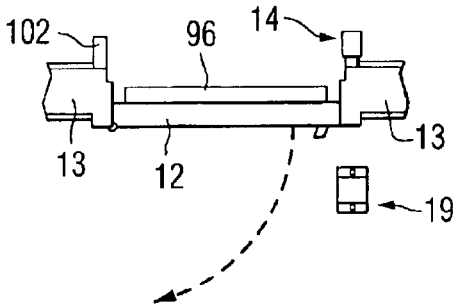
Figure 4D:
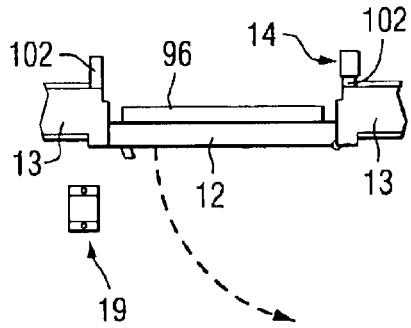

FIG. 3 illustrates one installation scenario for the portal access control system 20 of FIG. 2. The security door 12 is shown viewed from both the public and secure sides of the portal in the two views of FIG. 3. Certain of the components shown in FIG. 3 are identical and therefore bear the same reference characters as illustrated in FIGS. 1 and 2. Note that in FIG. 3 the authentication device 19 of FIG. 1 comprises a card reader 92. The programmable logic controller 30 accepts the input signals from and provides the output signals to the various devices comprising the portal access control system 20. To enter the secure side from the public side, the user swipes her card or badge through the card reader 92, and may also be prompted to enter a personal identification code into a keypad associated with the card reader 92. If authenticated, the security door 12 is released by de-energizing the electromagnet associated with the door lock 60. The user can then enter the secure side by pushing on a pushbar 96.

The local alarm 62 in this embodiment is a simple siren-type device triggered whenever the security door 12 remains open for a period beyond the door open limit time or if a tailgater is detected. Hinges 98 attach the security door 12 to the door frame 13 and are located on the secure side such that the door does not open into the area monitored by the door frame detectors 14 (not shown in FIG. 3). In this embodiment, passage from the secure side to the public side is also controlled and/or monitored by a card reader 93 located on the secure side of the security door 12. As with many of the plurality of features associated with the present invention, the site operator will determine whether it wishes to monitor and/or authenticate traffic from the secure side into the public side. If the user is authenticated by way of the card reader 93, the handle 100 is unlocked. The user turns the handles and pulls the door inwardly to exit the secure area into the public side.

One location for the programmable logic controller 30 is shown in FIG. 3, with power supplied from an external source. In one embodiment, the power is 120 VAC. The plurality of monitoring signals provided by the system are supplied to the programmable logic control 30 as discussed herein. These monitoring signals include the various inputs to the programmable logic control 30 as shown in FIG. 2. In the event of a fire or other emergency, signals are supplied to and provided by the programmable logic controller 30. For instance, if there is an emergency on the secure side, the security door 12 is immediately unlocked to permit egress from the secure side. Also, as shown the programmable logic controller 30 bi-directionally communicates with the security control center 68 to supply certain status and monitoring signals directly thereto (e.g. an alarm signal) and receive signals therefrom (for instance for operating a video camera 101).

FIGS. 4A through 4D are security door top views showing installation of extrusion frames 102 on the door frames 13, and the door frame detectors 14 for four different door implementations, i.e., a left hand door, right hand door, left hand reverse door and right hand reverse door. In all cases, the door opens away from the area monitored by the door frame detectors 14. Note further, as illustrated, in this embodiment access requires authentication only for passage from the public side to the secure side.

Figure 5:
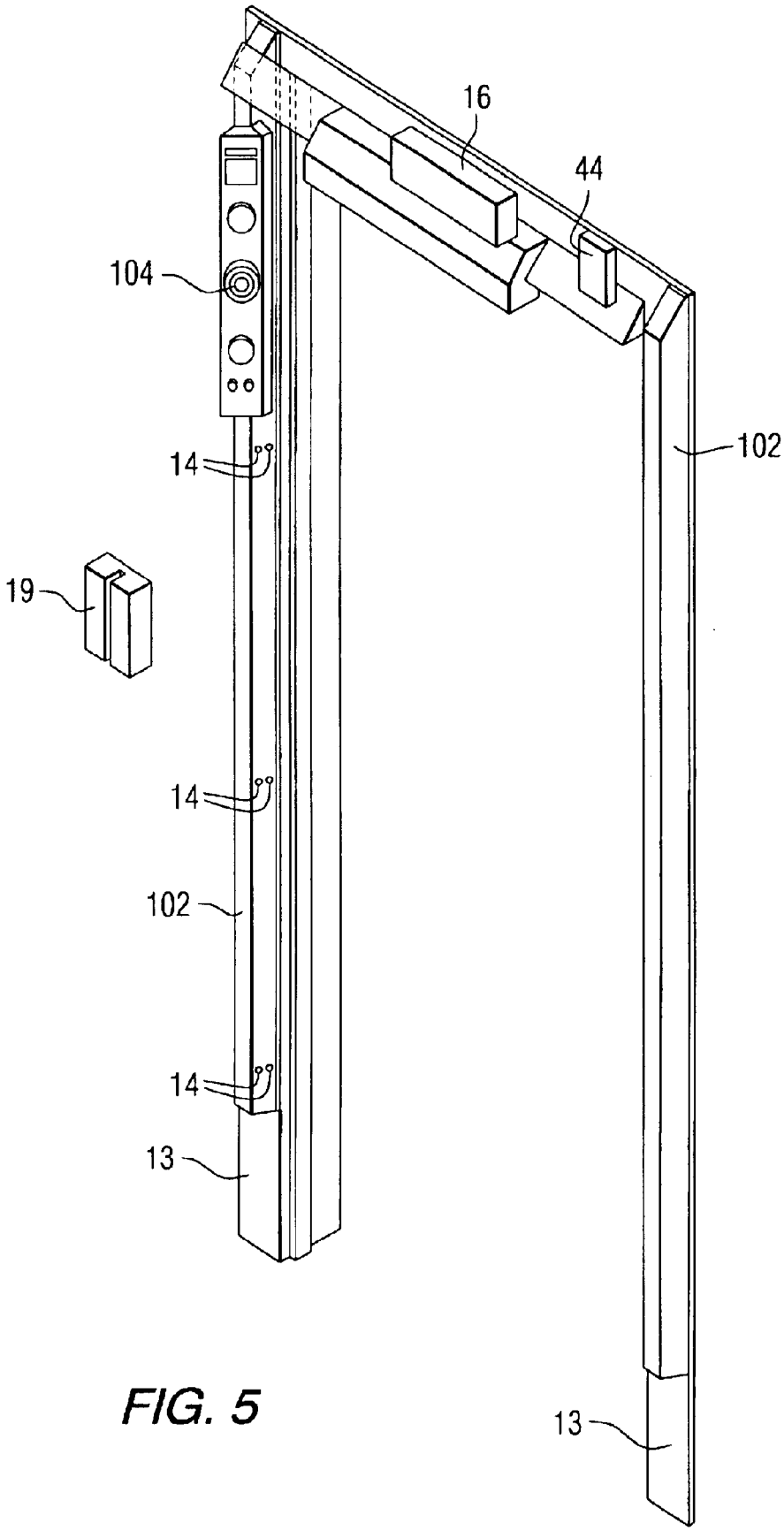
FIG. 5 is a diagrammatic representation of a door secured by the portal access control system of the present invention.

FIG. 5 is a perspective view of certain components of the portal access control system 20. As shown in this installation, the door frame extrusion 102 in which the door frame detectors 14 are installed, is attached to the front surface of the door frame 13. This embodiment shows the side-by-side mounting of pairs of door frame detectors for determining the direction of travel. A device 104 is shown, which in various embodiments of the present invention represents the passive IR detector 32, the motion detector 34 or the other presence or motion detectors 38. The device 104 can also represent any of the local communications devices 64, including, for example, a camera or public address system. The device 104 can also represent a local alarm, status indicator lights and/or a reset switch. In most applications, the existing door hardware and security elements are supplemented by various components of the present invention and the operational modes of the present invention are also determined by the existence of these elements. For example, if an existing security door includes a floor mat 18, then the presence signal provide by the floor mat 18 will be integrated into the analysis process executed by the present invention to determine whether an intruder has breached the security door 12. But, if no such floor mat is present, then the site operator may instead opt to use only the passive IR detector 32 and the motion detector 34 to detect presence on the public side and determine a breach based only on those two input parameters.

Figure 6A:
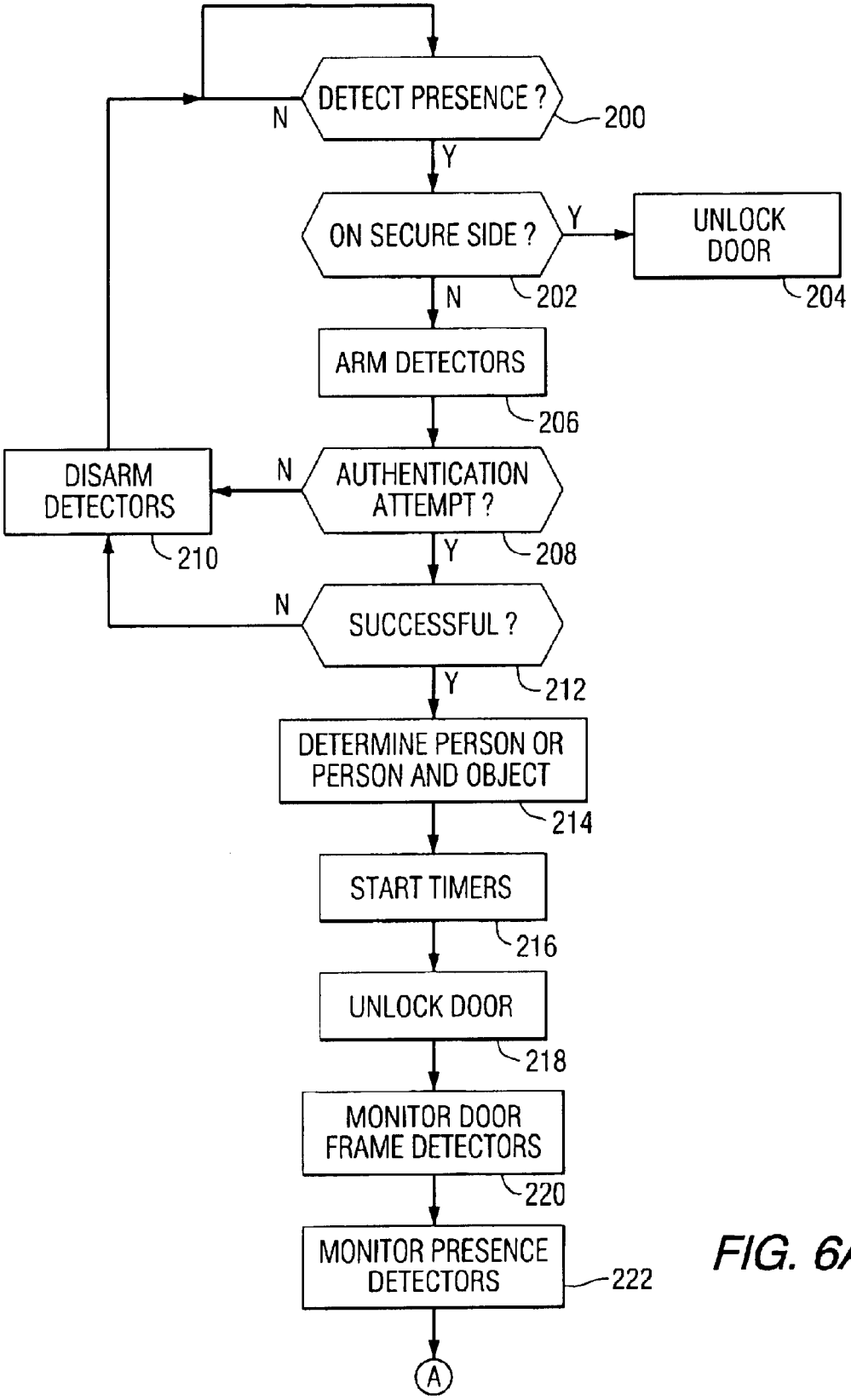
FIG. 6 is a flow chart illustrating the program steps of the portal access control system of the present invention.
Figure 6B:
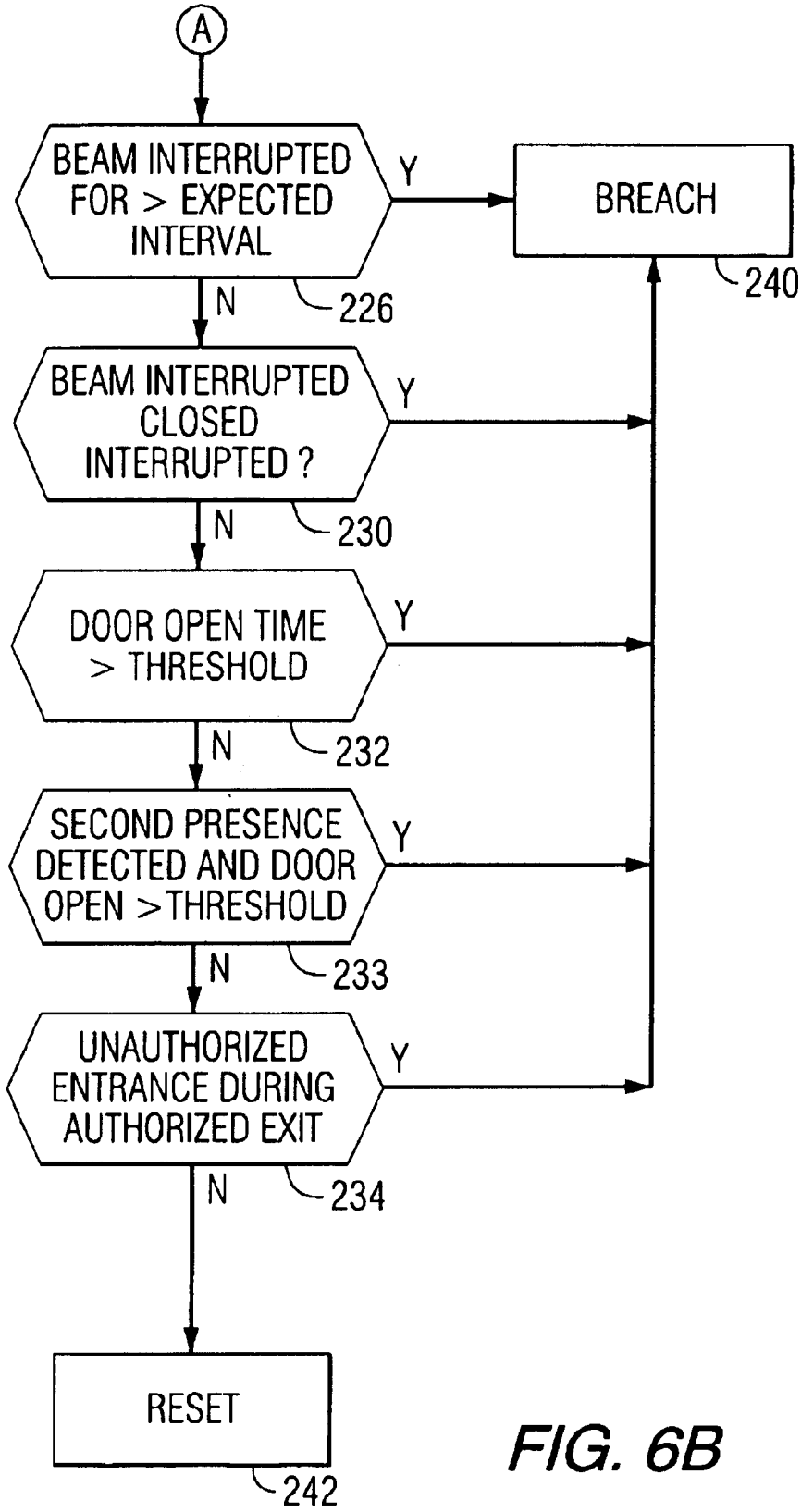

FIG. 6 is a flowchart according to one embodiment of the portal access control system 20. The flowchart of FIG. 6 is executed by the programmable logic controller, specifically by a special purpose processor or microcontroller therein. In another embodiment the program can be executed on an interrupt or time shared basis by another processing device within the system or on the site.

The FIG. 6 program begins at a decision step 200 for detecting the presence of person or object within the detection zone on the public side of the security door 12. Note in another embodiment, the presence detection can also be performed on the secure side of the security door 12 to determine the presence of someone intending to exit into the public side. It is not necessary to execute the presence detection step in every embodiment of the present invention. If not executed the detectors are always armed for detecting passage through the security door 12.

To carry out the presence detection process, one or more of the presence detectors discussed in conjunction with FIG. 2 are utilized, e.g., the passive infrared detector 32, the motion detector 34 and the floor mat 36. So long as no person or object is detected at the decision step 200, the process continues looping back through the detection process decision step 200 until a person or object is detected, after which the program flow proceeds to a decision step 202. The decision step 202 is required only in those installations where presence is detectable on both the public and secure sides of the security door 12. In this instance, if someone has been detected on the secure side and the installation allows free passage from the secure side to the public side then the security door 12 is unlocked at a step 204 and all alarms are deactivated. This feature could, for instance, further activate a counter for counting the passage of people from the secure side to the public side.

If the person or object was detected on the public side, thus presumably planning to enter the secure side, the process continues to a step 206 where the doorframe detectors are armed. In one embodiment, a tinier can be activated at this point to measure the time between detection and door closure after the person passes through the portal. Measuring this time interval between detection in the proximate zone and door closure, determining if it exceeds an average threshold and activating a camera or alarm if the threshold is exceeded, presents yet another opportunity to thwart suspected unauthorized entrants.

Another feature of the present invention is to measure the time during which the security door 12 is open so that unauthorized entrants can be detected, or at least suspected, if the security door 12 is open in excess of a predetermined time. If this time is exceeded, the programmable logic controller 30 sounds an alarm and activates the camera 22 to record the events occurring in the area of the security door 12

Next (see a step 208) the detected individual attempts authentication using the authentication device 19 mounted adjacent the security door 12. Typically, the authentication device is a card or badge reader. If there is not an authentication attempt within 10 seconds, for example, then the result at the decision step 208 is negative and the process moves to a step 210 where the detectors are disarmed. In this case, the person detected at the decision step 200 apparently decided not to enter the secure area or the presence detection components produced a false alarm.

If an authentication attempt was executed, the program flow moves to a decision step 212 to determine whether the individual is an authorized entrant to the secure area. The mechanisms for making this authentication decision are described above. If an authenticated individual swipes the card reader twice, then two individuals will be permitted to pass through the security door 12 to the secure side. If the result is negative, processing again flows to the disarm step 210. If the individual was successfully authenticated, then it is necessary to first determine whether the presence detector detected a person or a person who is carrying or transporting an object, such as a suitcase or a cart. To avoid false alarms of a portal breach, it is necessary to determine whether the authenticated individual will be passing through the portal with an object, as the object too may interrupt the light beams for a period longer than if a person alone passed through the threshold. Therefore, if an object is moving through the portal with an individual, (for example, if the individual is seated in a wheelchair) a timer must be established to allow both the individual and the object to pass through the portal before activating the alarms. The step 214 therefore requires close analysis of the results from the presence detection components and may in fact require analysis of results from more than a one presence detector. The results of this determination are then utilized to calculate an expected door-open time, representing the average time taken by a person, or a person plus an object, to pass through the security door 12. In another embodiment, security personnel can monitor real-time information, by way of a camera at the security door 12 for example, and control the activation of the timers to allow sufficient time for the person plus object to pass through the door.

At a step 216 two timers are activated. A first timer is set to an initial time value based on the average walking speed of an individual through the secure portal. The second timer is set to an initial time value based on the results of the determination at the step 214 as to whether the individual is proceeding with an object either ahead or behind him. The first timer is used in conjunction with monitoring of the door frame detectors 14, and the second in conjunction with monitoring the door open time.

In another embodiment, the timers are not utilized, as the system instead counts individuals passing through the door and compares the count with the number of authenticated individuals and the direction of travel for each. In yet another embodiment, another timer measures the time interval between authentication and door closure, again as a means of determining whether an unauthorized entrant has passed through the security door 12.

In one embodiment of the present invention a delay mode is available in which the security door 12 can be prevented from unlocking for a period of time, for example, 15 seconds. This allows sufficient time for security personnel to respond to a potential breach situation.

The security door 12 is then immediately unlocked at a step 218 while the timers continue to measure the elapsed time. Once the user enters the portal, the door frame detectors 14 detect his presence when his body breaks the beam emitted from a photo emitter mounted to one side frame 13 and reflected from the opposing side frame 13. In another embodiment, in lieu of using the reflective properties of the opposing door frame 13, a photo detector is mounted on the opposing door frame 13. Preferably, at least one door frame detector 14 is mounted at approximately waist height so that the time during which the beam is broken is maximized. If the door frame detectors are mounted lower, they may, for example, present a complete path when one leg passes in front of the other as the individual traverses the portal. Other door frame detectors can be mounted at different distances above ground level for determining information about an object that the individual may be transporting through the security door 12. For example, door frame detectors 14 can be mounted about 18 inches above the ground to detect the person carrying an object that extends in front of his body, because the beam from the lower door frame detectors 14 will be interrupted before the beam that is at waist height.

In the preferred embodiment, two door frame detectors 14 are mounted side-by-side; the order in which the detector beams are interrupted determines the direction in which the user is passing. In another embodiment according to the present invention, the door frame detectors 14 count the number of people passing through the security door 12 based on the number of times the beam is interrupted and the subsequent steps regarding various time intervals are not executed.

Continuing with the embodiment set forth in the FIG. 6 flowchart, in addition to monitoring the door frame detectors 14, the presence detector(s) are also monitored at this point in the process (see a step 222). If a potential tailgater is in the proximate zone, then this information is used in the detection process as discussed below.

In particular, several methodologies are used according to the teachings of the present invention to detect tailgaters passing through the portal immediately following an authenticated user. Generally, these algorithms are processed by a step 220 of FIG. 6, during which the status of the door frame detectors 14 (including those placed at various heights above floor level), the door position sensor 44 and the two timers are monitored.

One of the timers activated at the step 216 is used to detect a tailgater following in lock step behind an authenticated user, using the timer set to a time for a single user to pass through the portal. If this time threshold is exceeded, then it is likely two individuals, rather than one, attempted to pass through the portal, relying on only a single authentication. However, if two individuals were authenticated, then this evaluation is inactivated or the timer value is recalculated based on the time for two individuals to pass through the portal, plus a time representing the average distance between them. This analysis process is indicated at the decision step 226 of FIG. 6.

If the beams are first broken for a period (representing the passing of the authenticated user through the portal), followed by a period during which the beams are continuous (representing the space between the authenticated user and the unauthenticated tailgater), followed by a period during which the beams are broken again (representing the passing of the tailgater through the portal) then this too represents an unauthenticated entry. This analysis process is indicated at the decision step 230 of FIG. 6.

At a step 232 the door open time (as determined from the door position sensor 44) is compared with the second timer value determined at the step 214 and set at the step 216. This analysis determines whether the security door 12 has been held open for a period beyond the time expected for a person or a person plus an object to pass through.

At a decision step 233, if only one person has been authenticated through the door, but another person's presence has been detected by any one or more of the presence detectors, and the door has remained open for a time in excess of the door open timer setting (set at the step 216) then a tailgater has been detected.

At a decision step 234 another possible scenario is detected based on the information provided from the various sensors of the portal access control system 20. When an individual exits from the secure area to the public area the security door 12 remains open for a finite time after the individual passes through. During this period, an unauthorized individual can enter the secure area without execution of the authentication process. In fact, the perpetrator could even swipe a counterfeit badge through a card reader serving as the authentication device 19 and in this way appear to be an authorized entrant to the person exiting the secure area. This unauthorized entry can be detected in several ways.

First, if the person is not authenticated to pass to the secure side, and the door frame detectors 14 detect travel from the public side to the secure side (as distinguished from the persons exiting the secure side and passing to the public side), then an unauthorized entrant has been detected. Second, the process of authenticating with an authentication device on the secure side of the security door 12 or the persons passage from the secure side to the public side, can initiate a timer as in the steps 212 and 216 above. If an individual attempts to pass from the public side to the secure side (where the direction of travel is detected by the door frame detectors 14) after the timer has timed out, then a breach is detected. A more sophisticated process further includes the addition of a presence signal from one or more of the presence detectors on the public side, the floor mat 36, for example. Thus if a person is detected on the public side when the person is exiting the secure area, and the door frame detectors 14 detect a person moving from the public side to the secure side after the timer times out, then again a breach is detected. The perpetrator can also be detected in this scenario as the photodetectors 14 detect passage from the public side to the secure side without an accompanying authentication for that passage. This breach can also be detected by determining the direction of movement of each person passing through the open security door 12. One person will pass from the secure side to the public side, which is permitted. The other person will pass from the public side to the secure side, without a prior authorization and thus the breach is detected. Depending on the requirements and the selected detection process steps, these detection processes are executed at a step 234 of FIG. 6.

If any of the decision steps 226, 230, 232, 233 and 234 results in an affirmative response, then a breach is indicated at a step 240. Otherwise, the system is reset at a step 242 and returns to the decision step 200 for monitoring presence in the zone surrounding the security door 12. The various alarms and communications devices activated when a breach is declared were discussed above in conjunction with FIG. 2, including activation of the public address system to demand that the tailgater immediately depart the secure area and the initiation of video and audio recordings of the situation.

While the invention has been described with reference to preferred embodiments, it will be understood by those skilled in the art that various changes may be made and equivalent elements may be substituted for elements thereof without departing from the scope of the invention. In addition, modifications may be made to adapt a particular situation to the teachings of the present invention without departing from the essential scope thereof. Therefore, it is intended that the invention not be limited to the particular embodiment disclosed as the best mode contemplated for carrying out this invention but that the invention will include all other constructions falling within the scope of the appended claims.

What is claimed is:

1. A security system for controlling access by a person through a controlled portal, defined by a frame comprising two vertical members and an interconnecting horizontal member, comprising:

an authentication device to which a person seeking passage through the portal provides certain identifying information to determine whether the person is authorized to pass through the portal;

a locking device for retaining the portal in a locked mode and for unlocking of the portal when the person is authorized to pass therethrough;

a sensor mounted on one or both of the vertical members of the portal frame for determining the passage of a user through the portal and for providing a first signal representative thereof; and a controller responsive to said first signal for providing a second signal if the number of persons passing through the unlocked portal is greater than the number of persons authorized to pass through the portal.

2. The security system of claim 1 wherein the portal separates a public area from a secure area.

3. The security system of claim 1 wherein the authentication device is selected from among a card reader, a badge reader, a keypad, a biometrics reader and a key.

4. The security system of claim 3 wherein the authentication device receives input information from the person and compares the input information with stored information of authorized users to determine whether the user is an authorized user.

5. The security system of claim 1 wherein the sensor determines the time taken by the person to pass through the portal.

6. The security system of claim 1 further comprising a comparator, wherein the actual time taken by the person to pass through the portal is input to said comparator for determining the relationship between the actual time taken by the person to pass through the portal and a predetermined passage time through the portal, and wherein if the actual passage time is greater than the predetermined passage time, for providing a signal in response thereto.

7. The security system of claim 6 wherein the signal is an alarm.

8. The security system of claim 6 wherein the predetermined passage time is an average time taken by a person to pass through the portal.

9. The security system of claim 1 wherein the sensor comprises a plurality of electromagnetic radiation detecting sensors responsive to a electromagnetic radiation beam and mounted proximate the portal, and wherein the person passing through the portal interrupts said electromagnetic radiation beam, and wherein the interruption is detected by at least one of said plurality of electromagnetic radiation detecting sensors, and wherein in response thereto a person is determined to have passed through the portal.

10. The security system of claim 9 wherein the number of persons passing through the portal are counted based on the interruptions of the electromagnetic radiation beam.

11. The security system of claim 10 further comprising a comparator, wherein the number of persons passing through the portal is input to said comparator for comparing with the number of authorized persons, and if there is not a match therebetween, for providing an alarm signal in response thereto.

12. The security system of claim of claim 9 wherein the plurality of electromagnetic radiation detecting sensors comprise a plurality of light emitters for emitting a beam of electromagnetic energy, and wherein the beam is interrupted by a person or object passing through the portal.

13. The security system of claim 12 further comprising a frame surrounding the portal, wherein the plurality of light emitters are mounted to said frame.

14. The security system of claim 12 wherein the beam of electromagnetic energy is reflected from an opposingly oriented surface back to the plurality of light emitters, and wherein each one of the plurality of light emitters further comprises a light detector.

15. The security system of claim 12 further comprising a like plurality of light detectors mounted in opposing orientation to the plurality of light emitters for detecting the beam of electromagnetic energy.

16. The security system of claim 15 further comprising a frame surrounding the portal, wherein the plurality of light emitters and the plurality of light detectors are mounted in opposing orientation to said frame.

17. The security system of claim 12 wherein the portal comprises a hinged door supported by at least one of the vertical members, and wherein the hinged door opens in the direction away from the plurality of light emitters.

18. The security system of claim 9 wherein two of the plurality of electromagnetic radiation detecting sensors are mounted in a side-by-side orientation such that the direction of travel by a person through the portal can be determined based on the order in which the beams from the two of the plurality of electromagnetic radiation sensors is interrupted.

19. The security system of claim 9 wherein the plurality of electromagnetic radiation detecting sensors are mounted at differing heights above ground level for providing information about the person passing through the portal based on the pattern of the radiation beams that are interrupted, and wherein the plurality of electromagnetic radiation detecting sensors provide information as to whether the person passing through the portal is transporting an object through the portal.

20. The security system of claim 9 wherein the plurality of electromagnetic radiation detecting sensors detect the passage of two users through the portal by determining two beam interruptions.

21. The security system of claim 1 wherein the sensor counts the number of persons passing through the controlled portal.

22. The security system of claim 1 operative to control access through the portal in both directions.

23. A security system for controlling access of a person through a controlled portal, wherein the person may be transporting an object through the portal, comprising:

a presence detector located near the portal for sensing the presence of a person or a person and an object within an approach zone substantially adjacent to the portal and for determining certain physical characteristics of the object;

a controller for calculating the expected time for the person or the person and the object to pass through the portal based on the physical characteristics thereof, an authentication device to which the person seeking entry through the portal provides certain information for use by said authentication device to determine whether the person is authorized to pass through the portal;

a locking device for retaining the portal in a locked mode and for unlocking the portal when the person is authorized to pass therethrough; and a sensor mounted proximate to the portal for determining the passage of a person or a person and an object therethrough.

24. The security system of claim 23 wherein the presence detector is selected from among a motion detector, a passive infrared radiation detector, a floor mat adjacent the portal and a camera.

25. The security system of claim 24 wherein the camera produces a signal representative of the viewed image, and wherein said signal is transmitted to a security control center for analysis of the image.

26. The security system of claim 23 wherein the approach zone is controllable.

27. The security system of claim 23 wherein the presence detector provides a presence signal when the person or the person and the object is detected within the approach zone, and wherein the controller is responsive to said presence signal and to said sensor for determining if the presence of the person or the person and the object was detected after the sensor determined that the person or the person and the object have passed through the portal.

28. The security system of claim 23 wherein the presence detector further detects the presence of a person within said approach zone while said portal is unlocked.

29. The security system of claim 23 further comprising a camera for imaging the approach zone, wherein the presence detector activates the camera when a person or a person and an object are detected within the approach zone.

30. An access control vestibule separating a controlled access area from a public area, comprising:

a metal frame including sidewall frame sections defining the access controlled area;

a hinged door mounted to one of said sidewall frame sections;

a lock mechanism for holding the door in a locked configuration and for permitting the door to assume an unlocked configuration;

an authentication device for use by a person seeking admittance to the controlled access area;

a presence detector for determining the presence of a person proximate said door and for further determining whether the person is transporting an object;

a plurality of detectors mounted on the sidewall frame sections for measuring the transit time of a person through the vestibule;

a calculator for determining the expected transit time for the person to pass through the vestibule, when the door is in an unlocked configuration, based on the output signal from said presence detector; and a comparator for comparing the actual transit time with the expected transit time and for producing an alarm signal if the actual transit time is greater than the expected transit time.

31. A method for controlling ingress to and egress from a secure area using a locked portal, comprising:

determining if a person desiring entrance into the secure area is an authorized entrant into the secure area;

unlocking the locked portal if the person is an authorized entrant into the secure area;

detecting passage of the person through the unlocked portal;

determining the direction of travel of the person through the unlocked portal; and detecting passage of more than one person through the unlocked portal when only one person has been determined to be an authorized entrant into the secure area.

32. The method claim 31 further comprising:

unlocking the locked portal to permit a first person to pass out of the secure area; and detecting the passage of a second person into the secure area before the portal is again locked when the second person has not been determined to be an authorized entrant into the secure area.

33. The method of claim 32 wherein the step of detecting further comprises determining the direction of travel through the unlocked portal, such that the first person passing out of the secure area can be distinguished from the second person passing into the secure area.

34. The method of claim 31 further comprising detecting the presence of a person in an approach zone to the locked portal.

* * * * *

UNITED STATES PATENT AND TRADEMARK OFFICE

CERTIFICATE OF CORRECTION

PATENT NO. : 6,720,874 B2 
DATED : April 13, 2004
INVENTOR(S) : Michael Vincent Fufidio, Giuseppe Pino Baldassarre and Reginald Gary Moffat It is certified that error appears in the above-identified patent and that said Letters Patent is hereby corrected as shown below:

Title page,
Item [12], change "Fufido" to -- Fufidio --
Item [75], Inventors, change "Fufido" to -- Fufidio --

Signed and Sealed this

Tenth Day of August, 2004

JON W. DUDAS
*Acting Director of the United States Patent and Trademark Office*